US006931673B1

(12) United States Patent
Savage, Jr.

(10) Patent No.: US 6,931,673 B1
(45) Date of Patent: Aug. 23, 2005

(54) SYSTEM AND METHOD FOR IMPROVING THE INTERCONNECTION BETWEEN A POOL COVER AND A STORAGE REEL

(76) Inventor: Carl J. Savage, Jr., 405 Welsford Rd., Fairless Hills, PA (US) 19030

( * ) Notice: Subject to any disclaimer, the term of this patent is extended or adjusted under 35 U.S.C. 154(b) by 0 days.

(21) Appl. No.: 10/647,153

(22) Filed: Aug. 25, 2003

(51) Int. Cl.[7] ..... E04H 4/10
(52) U.S. Cl. ..... 4/502; 160/290.1; 160/389
(58) Field of Search ..... 4/502; 242/402, 242/407; 160/264, 265, 290.1, 383, 385, 160/389, 400, 404

(56) References Cited

U.S. PATENT DOCUMENTS 1,749,595 A * 3/1930 Dora ..... 160/400
1,960,434 A * 5/1934 Doscher ..... 160/389 X
3,019,450 A * 2/1962 Karasiewicz ..... 4/502
4,324,370 A * 4/1982 Guard et al. ..... 4/502 X
5,327,590 A 7/1994 Last ..... 4/502
6,014,778 A * 1/2000 Varnado ..... 4/502
6,026,522 A 2/2000 Last ..... 4/502

* cited by examiner

*Primary Examiner*—Robert M. Fetsuga
(74) *Attorney, Agent, or Firm*—LaMorte & Associates

(57) ABSTRACT

A system and method that improves the interconnection between a pool cover and a storage reel so that the pool cover can more readily be wound on the storage reel in an even manner. The system includes at least one rigid plate that is attached to an edge of the pool cover. The rigid plate can be either manufactured into the structure of the pool cover or retroactively added to the edge of the pool cover. A mechanical fastening system is provided that enables the rigid plates at the edge of the pool cover to be attached to the storage reel so that the edge of the pool cover is held parallel to the axis of rotation for the storage reel. In this manner, the edge of the pool cover is automatically aligned with the storage reel by attaching the rigid plate to the storage reel.

7 Claims, 3 Drawing Sheets

SYSTEM AND METHOD FOR IMPROVING THE INTERCONNECTION BETWEEN A POOL COVER AND A STORAGE REEL

BACKGROUND OF THE INVENTION

1. Field of the Invention

In general, the present invention relates to pool covers of the type that are stored on reels when not in use. More particularly, the present invention relates to devices and methods for interconnecting a pool cover to a storage reel.

2. Description of the Prior Art

There are many different types of pool covers for swimming pools and they are used for many different reasons. Some pool covers are used during the winter months to keep debris out of a pool. Some covers are placed on pools daily for safety, energy conservation or aesthetic reasons.

Most pool covers are made of flexible material and are shaped like the pool they cover. Such pool covers lay across the top of the pool, therein covering the surface of the pool. In large pools, such covers are often stored on and are deployed from a storage reel. One end of the pool cover is attached to the storage reel. The reel is rotated, to wind the pool cover onto the reel. When the cover is to be placed over the pool, the reel is moved to the edge of the pool. The free end of the pool cover is then pulled across the pool. The pool cover unwinds from the reel and covers the pool. In some prior art systems, the pool cover is manually wound and unwound from a storage reel. Such manual systems are exemplified by U.S. Pat. No. 6,026,522 to Last, entitled, Manual Cover Drive For Swimming Pools. Other prior art systems are automated, where the storage reel is rotated by motors. Such automated prior art systems are exemplified by U.S. Pat. No. 5,327,590 to Last, entitled Automatic Swimming Pool Cover With A Dual Hydraulic Drive System.

In the field of pool covers, many reels used to store pool covers are just as long as a pool is wide. As such, the storage reel for a pool cover is often more than ten feet long and can be twenty feet only. In many prior art cover designs, the pool cover attaches to the reel at only a few points along the length of the reel. The pool cover is typically attached to the reel using straps that extend from the cover. As is often the case, when the pool cover is wound onto the storage reel, the pool cover does not wind around the reel evenly, due to the lag in the pool cover in between the points of attachment. As a consequence, the pool cover buckles and folds as it winds onto the storage reel. The buckles and folds are very hard to correct because the body of the pool cover is lying over the pool. To correct the winding configuration of the pool cover, a person must jump into the pool and physically pull the pool cover to correct its orientation. This is rarely done so the pool cover ends up being wound with folds and buckles. This is unsightly. Furthermore, a pool cover that is wound unevenly not unwind evenly. It is therefore difficult to get the pool cover to again lay evenly across the top of the pool.

A need therefore exists for a system and method that can cause a pool cover to wind more evenly on a storage reel without buckles and folds. In this manner, the pool cover will wind evenly and unwind evenly, thereby making the application and the retraction of a pool cover less labor intensive. This need is met by the present invention as described and claimed below.

SUMMARY OF THE INVENTION

The present invention is a system and method that improves the interconnection between a pool cover and a storage reel so that the pool cover can more readily be wound on the storage reel in an even manner. The system includes at least one rigid plate that is attached to an edge of the pool cover. The rigid plate can be either manufactured into the structure of the pool cover or retroactively added to the edge of the pool cover.

A mechanical fastening system is provided that enables the rigid plates at the edge of the pool cover to be attached to the storage reel so that the edge of the pool cover is held parallel to the axis of rotation for the storage reel. In this manner, the edge of the pool cover is automatically aligned with the storage reel by attaching the rigid plate to the storage reel. Accordingly, the pool cover is automatically aligned onto the storage reel and is wound onto the storage reel without the need for constant adjustments to prevent buckles and folds.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be applied to any type of tarp that is stored on a reel, it is particularly well suited for use with pool covers. Accordingly, and by way of example, the present invention is illustrated and described as being applied to a pool cover in order to set forth the best mode contemplated for the invention. However, the application of the present invention to a pool tarp should not be considered a limitation of the scope of the invention as it is claimed.

Figure 1:
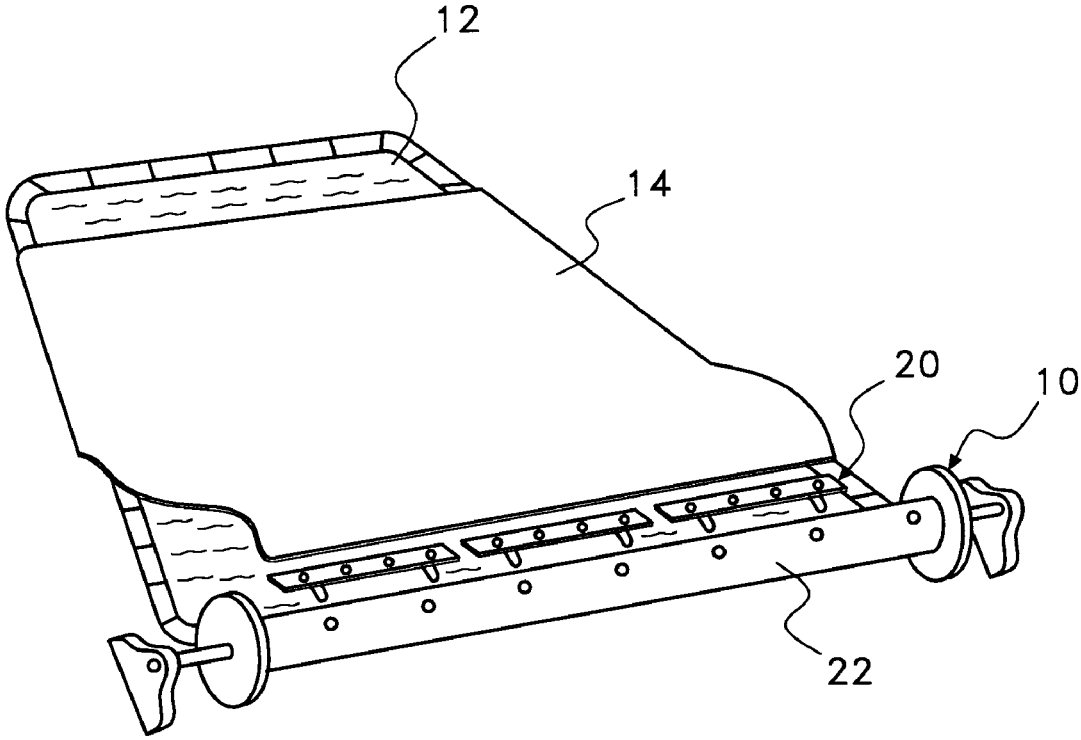
FIG. 1 is a perspective view of a pool and storage reel embodying the present invention system.

Referring to FIG. 1, a storage reel 10 is shown positioned along a side of a rectangular pool 12. The width of the storage reel 10 is slightly wider than that of the pool 12. For most standard sized pools, this would make the storage reel 10 between ten feet and twenty feet in length.

A standard pool cover 14 is provided. The pool cover 14 is a flexible fabric cover that is slightly larger in area than the pool 12. The pool cover 14 is drawn across the top of the pool 12 and covers the pool 12 during various periods when the pool 12 is unused.

The present invention is a system or kit that enables a standard pool cover 14 to be temporarily affixed to a standard storage reel 10 in a way that improves the ability of the pool cover 14 to be both wound onto the storage reel 10 and unwound from the storage reel 10.

In FIG. 1, it can be seen that a plurality of rigid mounting assemblies 20 are provided. The mounting assemblies 20 are coupled to the edge of the pool cover 14 nearest the storage reel 10 and remain affixed to the pool cover 14 both when the pool cover 14 is in use and when it is stored. Although three rigid mounting assemblies 20 are shown, it should be understood than one or any plurality of mounting assemblies 20 can be used. However, regardless of the number of rigid mounting assemblies 20 used, it is preferred that the length of the rigid mounting assemblies 20 be at least three feet long and in no case be less than one foot long.

The edge of the pool cover 14 is connected to the mounting assemblies 20 in a manner later described. Once the edge of the pool cover 14 is attached to the rigid mounting assemblies 20, the edge of the pool cover 14 cannot buckle or fold. Rather, the edge of the pool cover 14 is held open and taut by the presence of the rigid mounting assemblies 20.

The only place where the pool cover 14 is free to be folded is in between the rigid mounting assemblies 20. Thus, by having a plurality of rigid mounting assemblies 20 aligned along the edge of the pool cover 14, the pool cover 14 can still be folded on lines between the rigid mounting assemblies 20. This is useful during times when the storage reel 10 is not in use and the pool cover 14 is folded for convenience.

The rigid mounting assemblies 20 contain a coupling feature that enables the various rigid mounting assemblies 20 to be selectively attached to the core mandrel 22 of the storage reel 10. The rigid mounting assemblies 20 connect to the core mandrel 22 of the storage reel 10 so that the lengths of the rigid mounting assemblies 20 lay parallel to the central axis of the storage reel 10. Once the rigid mounting assemblies 20 are coupled to the storage reel 10, the rigid mounting assemblies 20 rotate with the storage reel 10 while maintaining their parallel configuration in relation to the central axis of the storage reel 10. As a result, when the storage reel 10 is rotated, the rigid mounting assemblies 20 evenly pull the pool cover onto the storage reel 10. This is done while keeping the edge of the pool cover 14 taut and unfolded. The result is that the pool cover 14 evenly rolls onto the storage reel 10. The pool cover 14 therefore tends to roll up evenly onto the storage reel 10 without significant buckles and folds.

Figure 2:
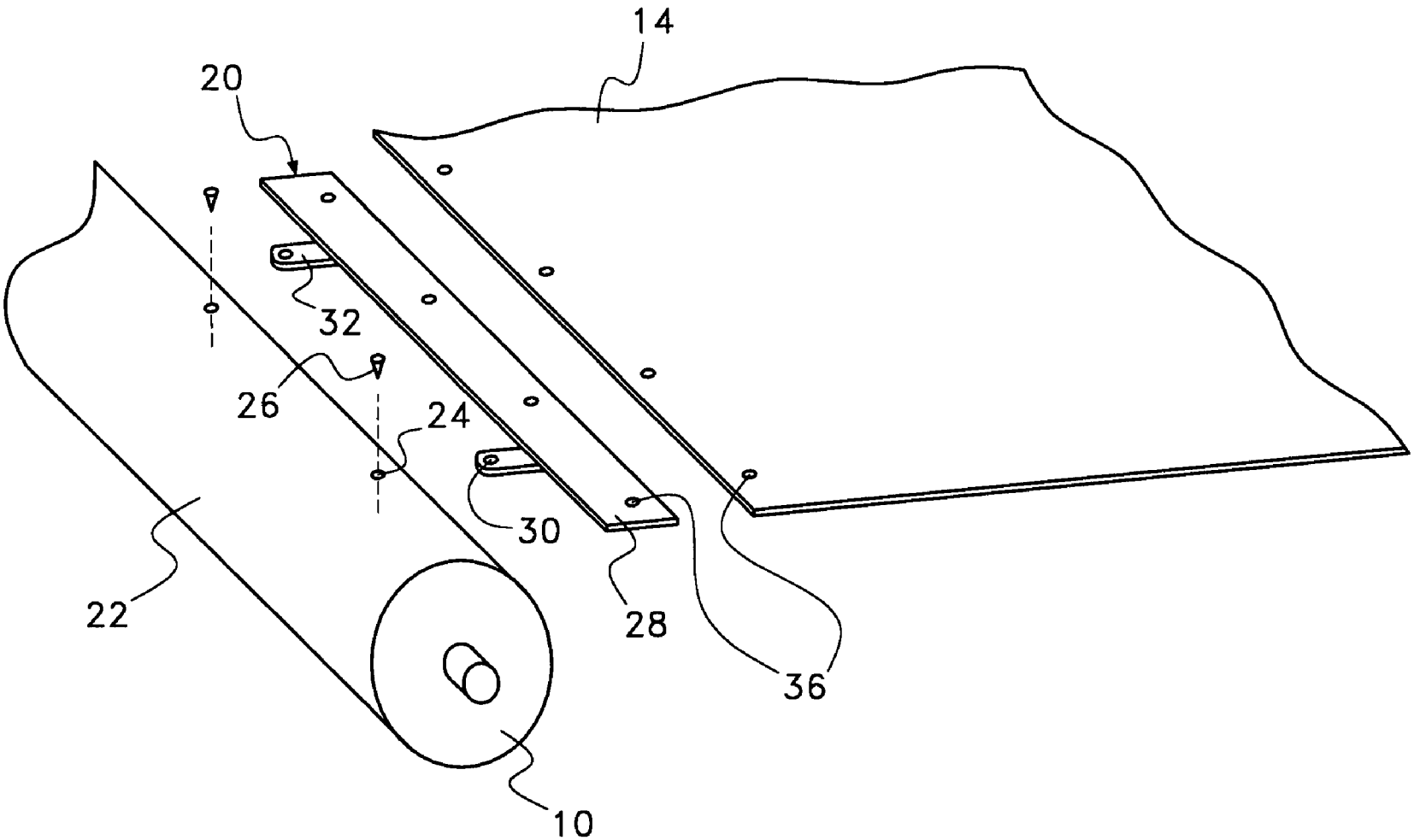
FIG. 2 is a perspective, exploded view of a first embodiment of the present invention system shown in accordance with a segment of a pool cover and a storage reel.

Referring to FIG. 2, a first example of how the rigid mounting assemblies 20 attach to the pool cover 14 and to the storage reel 10 is shown. For this embodiment, it is assumed that the pool cover 14 and the storage reel 10 are preexisting components at a particular pool. Thus, in the described embodiment, it is assumed that the present invention system is going to be retroactively added to existing equipment. Accordingly, the rigid mounting assemblies 20 are specifically designed to retroactively mount to both the pool cover 14 and the storage reel 10 with as little labor as possible.

In the embodiment of FIG. 2, it can be seen that snap connectors 24 are attached directly onto the core mandrel 22 of the storage reel 10. The snap connectors 24 are attached with mounting screws 26 that pass through the center of the snap connectors 24 and directly engage the core mandrel 22 of the storage reel 10. The snap connectors 24 are all attached to the core mandrel 22 in a straight line that is parallel to the central axis of rotation for the storage reel 10.

Each of the rigid mounting assemblies 20 includes a rigid plate 28. The rigid plate 28 is made of a rigid, but non-reactive material, such as plastic or aluminum. In this manner, the rigid plates 28 will not rust or otherwise oxidize when exposed to pool water or the chemicals typically found in pool water. Snap connectors 30 are attached to the rigid plates 28. The snap connectors 30 can be directly affixed to the rigid plates 28. However, if this is done, the snap connectors on the rigid plates 28 would have to be spaced in the exact same order as those on the core mandrel 22 of the storage reel 10. Since the snap connectors that are on the storage reel 10 may be attached retroactively by the owner of the pool, it is undesirable to require such close tolerances. Rather, as is shown by FIG. 2, flexible tabs 32 extend from the rigid plates 28. The snap connectors 30 are affixed to the flexible tabs 32. The flexible tabs 32 enable the snap connectors 30 to be varied in position throughout a small range. In this manner, the snap connectors 30 on the flexible tabs 32 can be readily attached to the snap connectors 24 on the core mandrel 22 of the storage reel 10 even if the snap connectors 24 on the storage reel 10 were haphazardly set into place.

Once the snap connectors 30 extending from the rigid plates 28 are connected to the corresponding snap connectors 24 on the core mandrel 22 of the storage reel 10, the rigid plates 28 interconnect with the storage reel 10. Once interconnected, each rigid plate 28 is held parallel to the central axis of the storage reel 10. This parallel orientation is maintained by the snap connections and remains unchanged even if uneven forces are applied to the rigid plates 28.

The snap connectors 24, 30 on the storage reel and the rigid plates 28 create a mechanical interconnection that can be easily undone. It will therefore be understood that the rigid plates 28 can be selectively attached and detached from the storage reel 10 as needed.

As earlier described, the edge of the pool cover 14 connects to the rigid plates 28. This interconnection can be done in many ways. In the shown embodiment, snap connectors 36 are affixed directly to the pool cover 14 and to the face of the rigid plates 28. The snap connectors 36 are preferably the same size as those used on the core mandrel 22 of the storage reel 10. In this manner, the edge of the pool cover 14 can be connected directly to the core mandrel 22 of the storage reel 10 if a rigid plate 28 is unavailable or undesired.

If a rigid plate 28 is not used, the edge of the pool cover 14 can be directly coupled to the core mandrel 22 of the storage reel 10. The interconnection of the edge of the pool cover 14 with the core mandrel 22 keeps the edge of the pool cover 14 taut as the pool cover 14 is wound onto the storage reel 10.

However, the use of the rigid plates 28 is desired because it is difficult to evenly pull the edge of the pool cover 14 onto the core mandrel 22 of the storage reel 10 for attachment. By providing the rigid plates 28, and attaching them to the edge of the pool cover 14, the edge of the pool cover 14 is always held taut. Thus, only the rigid plates 28 need to be pulled up and out of the pool for attachment to the storage reel 10. The rigid plates 28 automatically align the edge of the pool cover 14 so that the edge is parallel to the axis of rotation for the storage reel 10.

The present invention system therefore greatly simplifies the task of evenly attaching the pool cover 14 to the storage reel 10. Rather than pulling the edge of the pool cover unevenly put of the water and having it attach unevenly to the storage reel 10, the rigid plates 28 are simply lifted and attached to the storage reel 10. The rigid plates 28 automatically align the edge of the pool cover 14 with the storage reel 10 so that the pool cover 14 can be wound onto the storage reel 10 without buckling. The pool cover 14 therefore automatically winds evenly onto the storage reel 10 without the need for constant adjustment.

In the embodiment of FIG. 2, snap connectors were used as the mechanical fastening means to attach both the rigid plates 28 to the storage reel 10 and pool cover 14 to the rigid plates 28. The use of such mechanical fasteners is merely exemplary and it should be understood that many other mechanical fastening elements can be substituted. For example, hook and loop fastening material, such as Velcro, can be used in place of the snap connectors. Hooks, zippers, clamps and locking devises can also be used.

Figure 3:
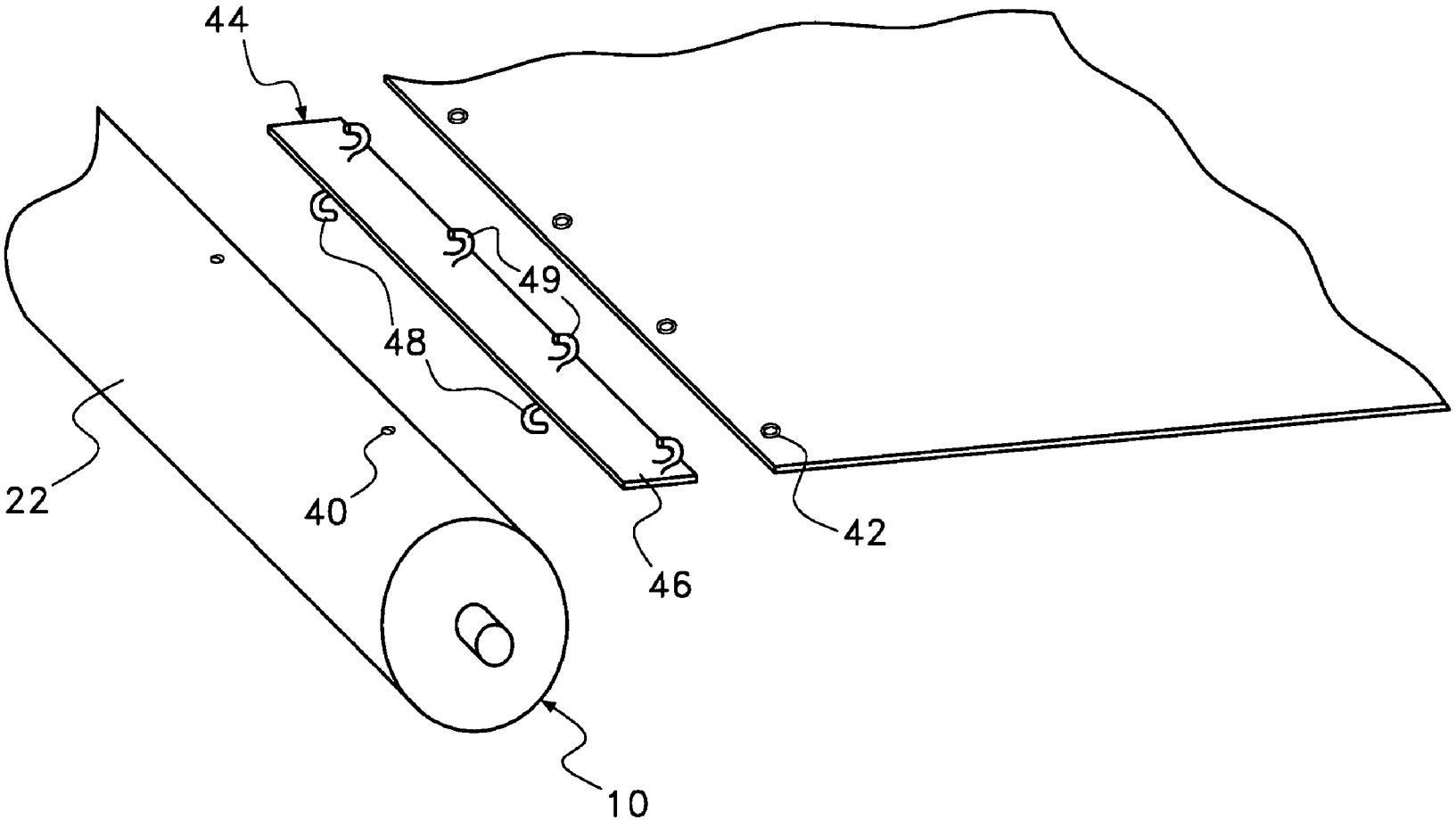
FIG. 3 is a perspective exploded view of a second embodiment of the present invention system shown in accordance with a segment of a pool cover and a storage reel.

One such alternate embodiment is set forth in FIG. 3. Referring to FIG. 3, it can be seen that a line of parallel holes 40 are drilled into the core mandrel 22 of the storage reel 10. Annular grommets 42 are placed along the edge of the pool cover 14 in a parallel line. Rigid mounting assemblies 44 are provided that interconnect the holes 40 on the storage reel 10 to the annular grommets 42 on the pool cover 14. Each rigid mounting assembly 44 includes a rigid plate 46. Extending from the rigid plate 46 are two sets of mechanical fasteners, in the form of hooks. One set of hooks 48 is positioned and sized to engage the holes 40 formed in the core mandrel 22 of the storage reel 10. The other set of hooks 49 are sized and positioned to engage the annular grommets 42 in the pool cover 14.

Each rigid plate 46 is first attached to the annular grommets 42 on the edge of the pool cover 14. Each rigid plate 46 is left attached to the pool cover 14, while the pool cover 14 is in use. When it is time to store the pool cover 14, the rigid plates 46 are attached to the core mandrel 22 of the storage reel 10 using the second set of hooks 49. The rigid plate 46 automatically align the edge of the pool cover 14 with the storage reel 10 so that the pool cover 14 can be wound onto the storage reel 10 without buckling. The pool cover 14 therefore automatically winds evenly onto the storage reel 10 without the need for constant adjustment.

In the embodiments of the present invention already described, the rigid mounting assemblies are retroactively added to the pool cover. It will be understood that the present invention system can be built into the structure of the pool cover and storage reel during the manufacture of these elements. Thus, rigid plates can be sewn into the edge of the pool cover or can be adhesively bound to the surface of the pool cover.

It will be understood that the embodiments of the present invention system and method that are described and illustrated herein are merely exemplary and a person skilled in the art can make many variations to the embodiments shown without departing from the scope of the present invention. For example, the size and attachment means associated with the rigid plates can be altered in many ways. All such variations, modifications and alternate embodiments are intended to be included within the scope of the present invention as defined by the appended claims.

What is claimed is:

1. A system for retroactively altering a pool cover and a pool cover storage reel to improve the ability of the pool cover to be evenly wound about the storage reel, said system including:

a plurality of rigid plates;

a first set of fasteners for selectively attaching said rigid plates to an edge of said pool cover, wherein said rigid plates attach linearly along said edge and leave spaces along said edge in between said rigid plates that enable said pool cover to be folded along said edge at said spaces; and a second set of fasteners for selectively attaching said rigid plates to said storage reel.

2. The system according to claim 1, wherein said first set of fasteners are selected from a group consisting of snap connectors, hook connectors, and hoop and loop connectors.

3. A pool cover system, comprising:

a storage reel having a central mandrel that extends along a central axis;

a pool cover having an edge;

a plurality of rigid plates coupled to said edge of said pool cover, wherein each of said rigid plates are at least one foot long and linearly aligned along said edge, and wherein a space exists between each of said rigid plates that allows said pool cover to be folded across said edge in between said rigid plates;

a first set of mechanical fasteners disposed between said rigid plates and said central mandrel that selectively interconnect said rigid plates to said central mandrel in an orientation parallel to said central axis.

4. The system according to claim 3, wherein said rigid plates are selectively detachable from said pool cover.

5. The system according to claim 3, further including a second set of mechanical fasteners for selectively interconnecting said edge of said pool cover to said rigid plates.

6. The system according to claim 5, wherein said first set of mechanical fasteners and said second set of mechanical fasteners are the same type of fastener.

7. The system according to claim 6, wherein said first set of mechanical fasteners is selected from a group consisting of snap connectors, hook connectors, hook and loop fasteners, and clevis fasteners.

* * * * *